US009494337B2

(12) United States Patent
Ragg

(10) Patent No.: US 9,494,337 B2
(45) Date of Patent: Nov. 15, 2016

(54) APPARATUS FOR HEATING AIR

(75) Inventor: Christopher William Ragg, Belfast (GB)

(73) Assignee: Munster Simms Engineering Limited, Bangor (GB)

( * ) Notice: Subject to any disclaimer, the term of this patent is extended or adjusted under 35 U.S.C. 154(b) by 961 days.

(21) Appl. No.: 13/395,221

(22) PCT Filed: Sep. 7, 2010

(86) PCT No.: PCT/EP2010/063130

§ 371 (c)(1),
(2), (4) Date: Apr. 19, 2012

(87) PCT Pub. No.: WO2011/029826

PCT Pub. Date: Mar. 17, 2011

(65) Prior Publication Data

US 2013/0016958 A1 Jan. 17, 2013

(30) Foreign Application Priority Data

Sep. 10, 2009 (GB) ..... 0915825.4

(51) Int. Cl.

| | |
|---|---|
| ***F24H 3/00*** | (2006.01) |
| ***F24H 9/18*** | (2006.01) |
| ***F24H 9/06*** | (2006.01) |
| ***F24H 3/02*** | (2006.01) |
| ***F24H 3/04*** | (2006.01) |
| ***F24H 3/12*** | (2006.01) |

(52) U.S. Cl.

CPC ..... *F24H 3/002* (2013.01); *F24H 3/022* (2013.01); *F24H 3/0405* (2013.01); *F24H 3/12* (2013.01); *F24H 9/1872* (2013.01)

(58) Field of Classification Search

CPC ..... F24H 3/002; F24H 3/022; F24H 3/12; F24H 3/0405; F24H 9/1872

See application file for complete search history.

(56) References Cited

U.S. PATENT DOCUMENTS

| | | | | |
|---|---|---|---|---|
| 1,841,380 | A * | 1/1932 | Phelps | F28D 1/0233 165/131 |
| 1,879,889 | A | 9/1932 | Ballentine | |
| 2,455,839 | A * | 12/1948 | Walton | 219/539 |
| 2,527,013 | A | 10/1950 | Kjelgaard | |

(Continued)

FOREIGN PATENT DOCUMENTS

| | | | | |
|---|---|---|---|---|
| EP | 2385744 | | 11/2011 | |
| EP | 2385744 | A1 * | 11/2011 | B60H 1/2225 |

(Continued)

OTHER PUBLICATIONS

International Preliminary Report on Patentability, dated Feb. 19, 2013, corresponding to International Application No. PCT/EP2010/063130 (Sep. 7, 2010), parent of the present application, 8 pp.

(Continued)

*Primary Examiner* — David Angwin
*Assistant Examiner* — John J Norton
(74) *Attorney, Agent, or Firm* — Lathrop & Gage LLP

(57) ABSTRACT

An apparatus for heating air comprising an elongate body adapted to receive, or integrally formed with, one or more electrical heating elements in thermal contact therewith, said body comprising a plurality of heat exchange fins defining a plurality of axially extending flow passages therebetween for heating air flowing therethrough.

11 Claims, 4 Drawing Sheets

(56) References Cited

U.S. PATENT DOCUMENTS

| | | | | |
|---|---|---|---|---|
| 2,797,297 | A | 6/1957 | Nihlen | |
| 2,819,375 | A * | 1/1958 | Mohn | F24H 3/002 338/318 |
| 3,672,446 | A * | 6/1972 | Tibbetts | B21C 37/225 165/183 |
| 3,942,587 | A * | 3/1976 | Favier | 165/129 |
| 4,417,131 | A * | 11/1983 | Carl | 392/307 |
| 4,487,256 | A * | 12/1984 | Lutjens | F28F 1/20 165/183 |
| 5,488,218 | A * | 1/1996 | Olsen et al. | 219/492 |
| 2003/0128971 | A1 * | 7/2003 | Birdsell | F24H 3/0417 392/368 |
| 2004/0151480 | A1 * | 8/2004 | Ito et al. | 392/307 |

FOREIGN PATENT DOCUMENTS

| | | |
|---|---|---|
| GB | 1588120 | 4/1981 |
| GB | 2082310 | 3/1982 |

OTHER PUBLICATIONS

Search Report, dated Jan. 30, 2013, corresponding to International Application No. PCT/EP2010/063130 (filed Sep. 7, 2010), parent of the present application, 5 pp.

Written Opinion, dated Jan. 30, 2013, corresponding to International Application No. PCT/EP2010/063130 (filed Sep. 7, 2010), parent of the present application, 7 pp.

* cited by examiner

APPARATUS FOR HEATING AIR

CROSS-REFERENCE TO RELATED APPLICATIONS

This application is the U.S. National Stage of International Application No. PCT/EP2010/063130, filed Sep. 7, 2010, which claims the benefit of United Kingdom Patent Application No. GB 0915825.4, filed Sep. 10, 2009, both of which are hereby incorporated by reference to the extent not inconsistent with the disclosure herewith.

The present invention relates to an apparatus for heating air and in particular to an electric heating apparatus for heating air, for example in a space heater for a small enclosed space, such as a caravan or camper, and to an improved space heater.

Space heaters are provided for heating an enclosed space to maintain the air and surroundings at a comfortable temperature for the occupants thereof. Caravans, camper vans and small dwellings are typically provided with small space heaters for heating the air within such spaces for the comfort of their occupants. Known space heaters frequently comprise a means for heating air, such as a gas burner or electrical heating element, and a fan for moving air past the heating means and into the space to be heated through suitable ducting. Such air moving means may comprise fans or the heated air may be simply be moved by convection.

A common type of space heater used in small space, such as caravans and campers, comprises a gas fuelled heater comprising a housing containing a fan that draws air into, and pushes it around, a circuit within the housing, within which the air is heated by a gas burner before the heated air is expelled from an outlet duct. Such gas fuelled space heaters are typically fuelled by gas stored in liquid form in a gas storage cylinder. A problem with such known gas fuelled space heaters is that the gas contained within the storage cylinder frequently runs out with little warning and a replacement may not be available. Also the combustion of gas requires a flue to extract noxious exhaust gases, such as carbon monoxide, and can lead to condensation problems.

There is a desire to increase the functionality of such known gas fuelled space heaters by providing an additional electrical heating element so that the user can chose either to heat the air by gas, or to heat it via the electric heating element. Others have tried to combine these two heating methods and, to this end, have incorporated electrical heating elements inside the main body of the space heater. This has been done in a convection type heater in which the air is not drawn through the heater by a fan but instead is allowed to make its way slowly through the heater and therefore around the heating element. However, this type of solution is not suitable for a space heater that is fan driven because the air will not have sufficient time to heat up. Current convection heating systems are not suited to fan driven air due to the much lower air speeds involved.

According to the present invention there is provided an apparatus for heating air comprising an elongate body adapted to receive, or integrally formed with, one or more electrical heating elements in thermal contact therewith, said body comprising a plurality of heat exchange fins defining a plurality of axially extending flow passages therebetween for heating air flowing therethrough.

Preferably said heat exchange fins are arranged to extend axially along the length of the elongate body to define axially extending air flow paths therebetween.

Preferably said apparatus further comprising a cylindrical duct within which said elongate body is located whereby said duct defines a shroud around said elongate body. Preferably said duct comprises an air flow path of a space heater. The cylindrical duct may comprise an outlet duct of a space heater for heating an enclosed space, such as a caravan or camper. The space heater may be provided with a primary heating means, such as a gas burner, said elongate body comprising a heat exchanger of a secondary or alternative heating means of the space heater in the form of an electrical heater.

Preferably said heat exchange fins extend substantially radially from a central region of the body to extend towards the inner wall of the duct. Preferably said fins terminate at or adjacent said inner wall of the duct to partition the interior of the duct into a plurality of parallel air flow paths.

Preferably the fins are arranged and spaced to provide a substantially even heat transfer to the air flowing through said duct.

The apparatus may comprise two or more heating elements to enable the device to comprise two or more heat setting by selectively activating one or more or said heating elements.

In one embodiment said apparatus comprises two heating elements to provide two heat settings.

In one embodiment the elongate body is formed from at least two parts, said one or more heating elements being provided in a recess defined between said parts such that said parts can be separated to insert or remove said one or more heating elements. Said parts may be separable in a plane coincident with the longitudinal axis of the elongate body. Said parts may be secured together by suitable fastening means, such as screws.

Two laterally spaced and mutually parallel axially extending elongate tubes may be defined within the elongate body, each tube being adapted to receive an elongate cylindrical heating element therein. Said elongate tubes may be defined between separable parts of the elongate body.

In a preferred embodiment said one or more electrical heating elements comprise a PTC electrical heater or any other suitable electrical heating device.

Preferably the elongate body is formed from a thermally conductive material, such as a metal. In one embodiment said body is formed from aluminium or an aluminium alloy. Said body may be formed from one or more extrusions, preferably from a pair of extruded section defining mirror image halves of said elongate body split along the longitudinal axis of the body.

Preferably the body includes at least one outer portion, preferably extending parallel to the longitudinal central axis of the elongate body, to provide a support for a thermocouple or other temperature sensor.

Preferably the body is formed from two halves separable along the longitudinal axis of elongate body, each half being provided with a longitudinally extending flange arranged parallel to a split line between the halves whereby said flanges may support fasteners for securing the two halves together.

According to a further aspect of the present invention there is provided a space heater comprising a housing defining an air circuit therein, a fan being provided within the housing for moving air between an air inlet and an air outlet of the air circuit, said air circuit being provided with first heating means in the form of a gas burner and second heating means in the form of one or more electrical heating elements, wherein said one or more electrical heating elements are located within an elongate body comprising a plurality of heat exchange fins defining a plurality of flow passages therebetween for heating air flowing therethrough, said elongate body being located within an air duct forming part of said air circuit.

Preferably said elongate body is mounted within an outlet portion of the air circuit, more preferably within an outlet air pipe.

An embodiment of the present invention will now be described, by way of example only, with reference to the accompanying drawings, in which:—

Figure 2:
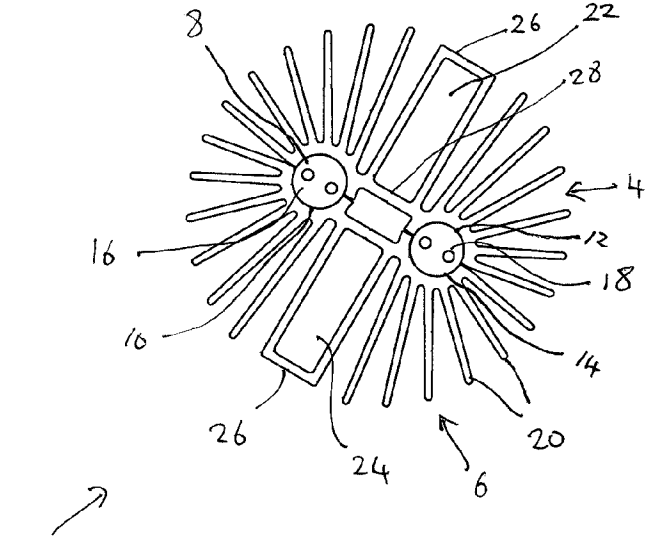
FIG. 2 is an end view of the apparatus of FIG. 1.
Figure 4:
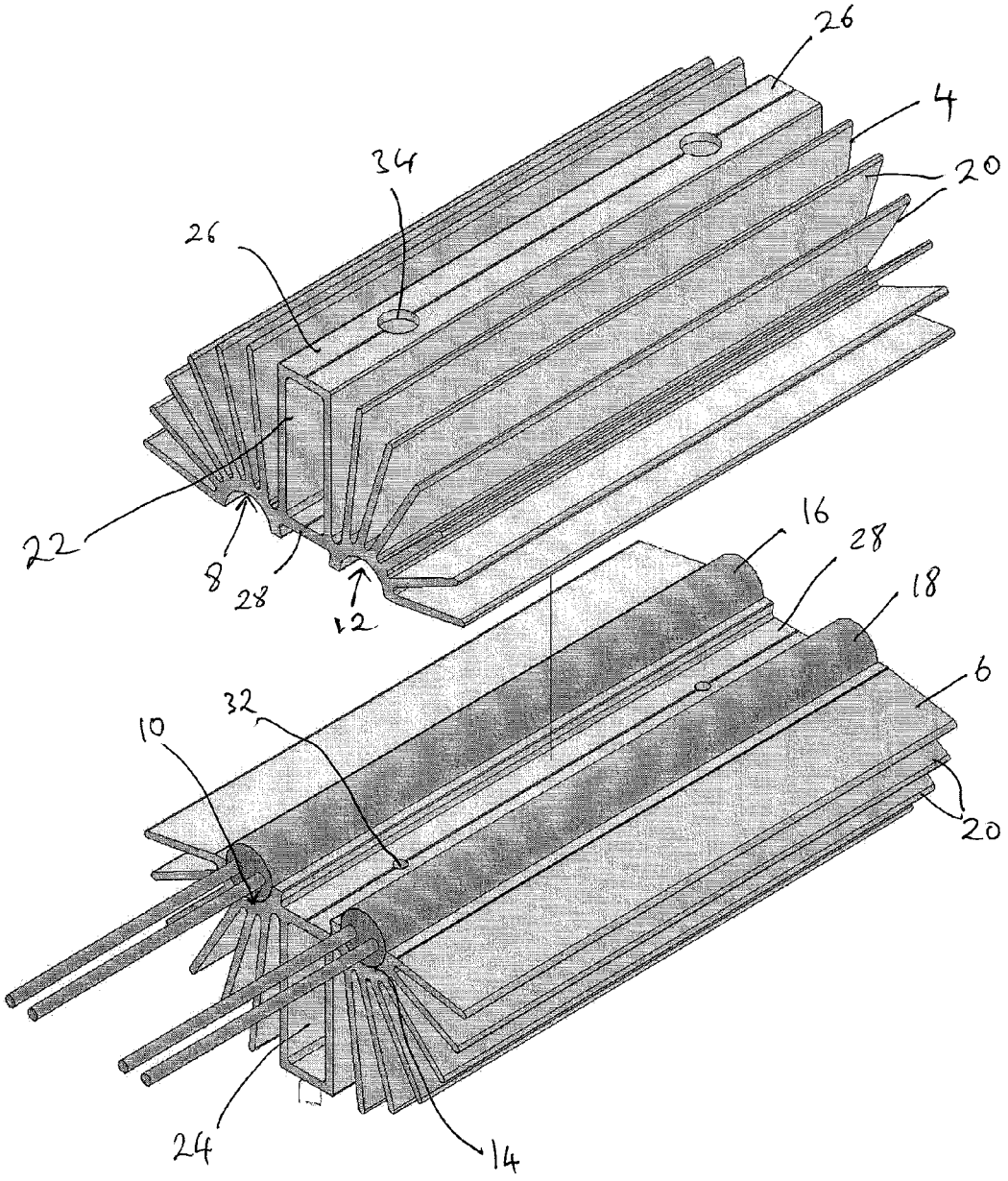
FIG. 4 is an exploded view of the apparatus of FIG. 1.

An electrical heating apparatus for heating air according to an embodiment of the present invention, as illustrated in the drawings, comprises an elongate extruded aluminium body 2 formed from two halves 4,6 connected together in a plane aligned with a central axis of the body 2. Each half 4,6 of the body 2 has a pair of parallel spaced apart semi-circular elongate recesses 8,10,12,14 formed therein which respectively cooperate with corresponding recesses on the other half when the two halves 4,6 of the body 2 are connected together to define respective tubular recesses for receiving heating elements 16,18, such as PTC heating elements, as best seen in FIGS. 2 and 4, such that the heating elements 16,18 are in thermal contact with the thermally conductive body 2. The recesses 8,10,12,14 extend parallel to the longitudinal axis of the elongate body 2 such that the heating elements 16,18 are mounted along the length of the elongate body.

The body 2 comprises a plurality of substantially radially extending heat exchanging fins 20 to maximise the surface area of the body 2 that is exposed to air to maximise heat transfer to air passing between the fins 20 of the body 2.

Figure 1:
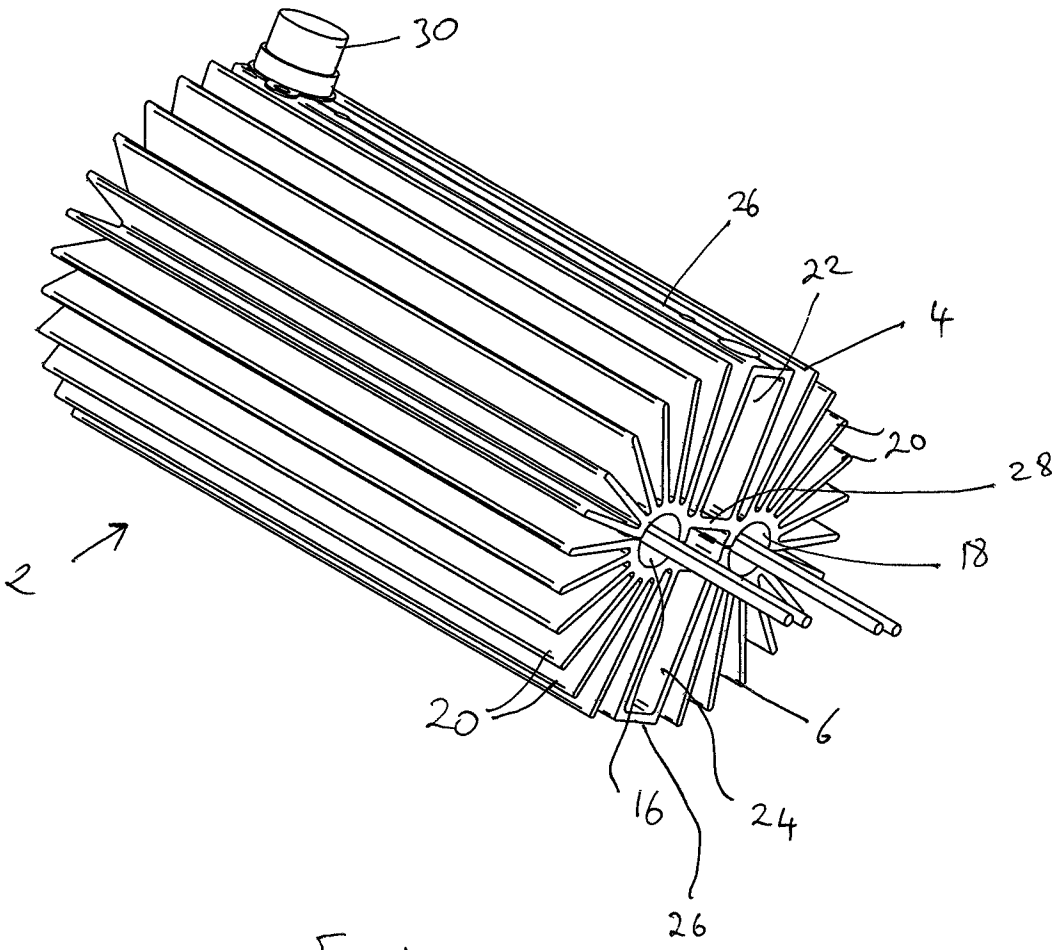
FIG. 1 is a perspective view of a heating apparatus according to an embodiment of the present invention.
Figure 3:
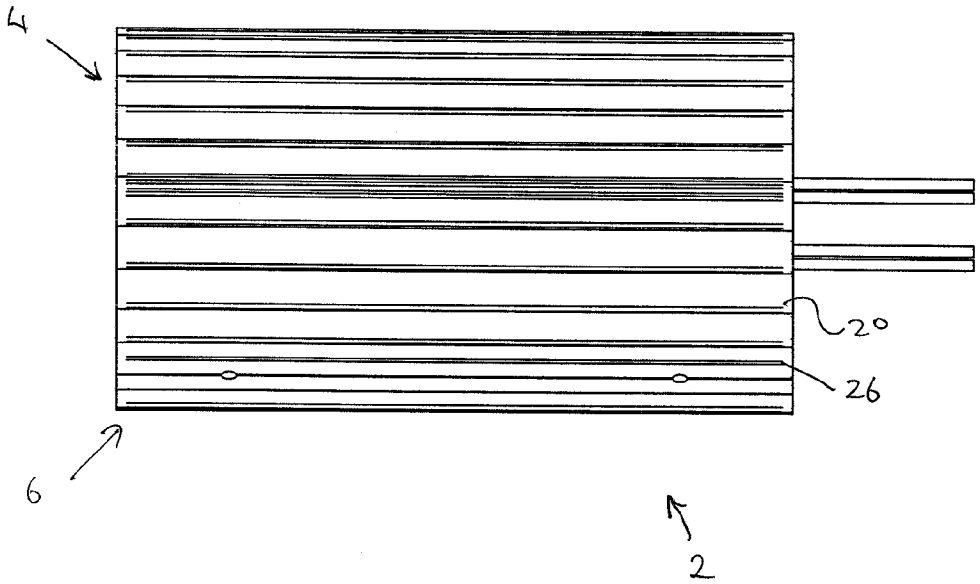
FIG. 3 is a side view of the apparatus of FIG. 1.

A substantially central portion of each half of the body comprises a box section shaped region 22,24 defining a flat outer flange 26 extending along the length of the elongate body, upon which can be mounted a thermocouple 30, as shown in FIG. 1, and an inner flange 28 extending between the heating element receiving recesses. Apertures 32 are provided in the inner flange 28 for receiving threaded or self tapping fasteners for securing the two halves of the body together. Larger diameter apertures 34 are formed in the outer flange 26 in alignment with the apertures 32 in the inner flange 28 to allow insertion of such fasteners and access to the fasteners for a suitable tool, such as a screw driver or socket.

Figure 5:
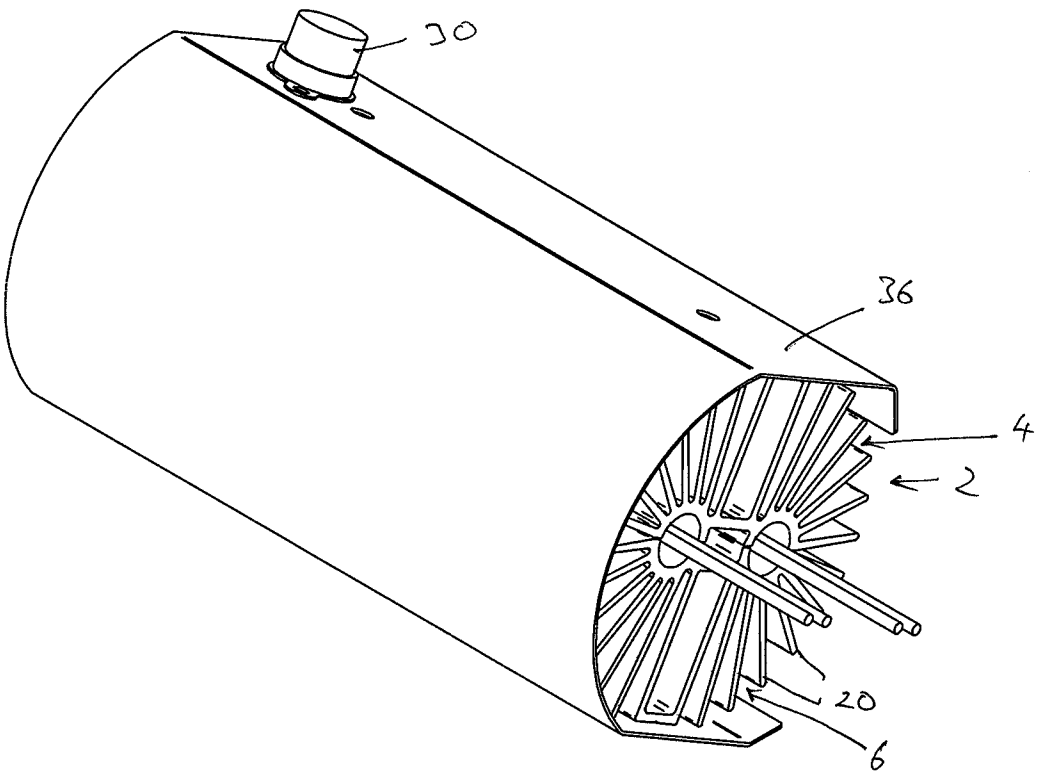
FIG. 5 is a perspective view of the apparatus of FIG. 1 fitted into an air flow duct.

As shown in FIG. 5, the body 2 can be located within an outer shell or tube defining a duct 36 of a space heater such that air passing through the duct 36 must pass between the fins 20 of the body 2, such fins 20 transferring heat to the air during passage therethrough when the body 2 is heated by one or both of the heating elements 16,18 mounted therein.

Such duct 36 may comprise an outlet duct of a gas fuelled space heater. By providing an electrical heating device in the outlet duct or nozzle of an existing space heater there is no need to modify the internal workings of the existing gas space heater.

The heating elements 16,18, which are located generally at the centre of the elongate body 2, each heat the body, in particular the fins 20 thereof, such that the air passing longitudinally over the fins 20 and is heated. The central box section region 22,24 of each half 4,6 of the body 2 serves two purposes, firstly to allow the two halves 4,6 to be screwed together and secondly to provide a suitable position to place an overheat thermostat 30. The fins 20 do not actually project radially from the centre of the body 2 but are slightly obliquely disposed. The reason for this is to create an even heat distribution, which would not otherwise be obtained because of the symmetry of the body (i.e. the fact that there are two spaced apart heating elements at the core rather than a single element and they are separated by the box section).

The provision of two separate heating elements 16,18 enables the air heater to provide two heat settings, whereby only one heating element is powered in a lower heat setting while both heating elements are powered at a high heat setting.

The invention is not limited to the embodiment(s) described herein but can be amended or modified without departing from the scope of the present invention.

The invention claimed is:

1. An apparatus for heating air comprising an elongate body adapted to receive, or integrally formed with, two or more heating elements in thermal contact therewith, said body comprising a plurality of heat exchange fins defining a plurality of axially extending flow passages therebetween for heating air flowing therethrough, and wherein the elongate body comprises two laterally spaced tubular recesses extending parallel to the longitudinal axis wherein each recess contains one of the heating elements such that the heating elements are in direct thermal contact with the elongate body, wherein the elongate body is formed from two halves separable in a plane coincident with the longitudinal axis of the elongate body and the tubular recesses such that the halves of the body can be separated to insert or remove the heating elements, and wherein each half of the body comprises a box section shaped central region defining a flat outer flange extending along the length of the elongate body and an inner flange, each flange having apertures formed therein for receiving fasteners for securing the two halves of the body together, wherein the apertures in the outer flange have a larger diameter than the apertures in the inner flange and are in alignment with the apertures in the inner flange to allow insertion of the fasteners and access to the fasteners.

2. An apparatus as claimed in claim 1, wherein said heat exchange fins are arranged to extend axially along the length of the elongate body to define axially extending air flow paths therebetween.

3. An apparatus as claimed in claim 1, wherein said apparatus further comprising a cylindrical duct within which said elongate body is located whereby said duct defines a shroud around said elongate body.

4. An apparatus as claimed in claim 3, wherein said duct comprises an air flow path.

5. An apparatus as claimed in claim 4, wherein the cylindrical duct comprises an outlet duct for heating an enclosed space.

6. An apparatus as claimed in claim 3, wherein said heat exchange fins extend substantially radially from a central region of the body to extend towards the inner wall of the duct.

7. An apparatus as claimed in claim 6, wherein said fins terminate at or adjacent said inner wall of the duct to partition the interior of the duct into a plurality of parallel air flow paths.

8. An apparatus as claimed in claim 3, wherein the fins are arranged and spaced to provide a substantially even heat transfer to the air flowing through said duct.

9. An apparatus as claimed in claim 1, wherein the two or more heating elements comprise electrical heating devices.

10. An apparatus as claimed in claim 1, wherein the elongate body is formed from a thermally conductive material.

11. An apparatus as claimed in claim 1, wherein the body includes at least one outer portion, to provide a support for a thermocouple.

* * * * *